US006211843B1

(12) United States Patent
Antipov et al.

(10) Patent No.: US 6,211,843 B1
(45) Date of Patent: Apr. 3, 2001

(54) COVER FOR CAMOUFLAGING MILITARY FACILITIES

(75) Inventors: Anatoly Petrovich Antipov; Igor Nikolaevich Permyakov, both of Moskovskaya oblast; Sergei Ivanovich Smolin, Moscow, all of (RU)

(73) Assignee: Otkrytoe Aktsionernoe Obschestvo "Nauchno-Issledovatelsky Institut Stali", Moscow (RU)

( * ) Notice: Subject to any disclaimer, the term of this patent is extended or adjusted under 35 U.S.C. 154(b) by 0 days.

(21) Appl. No.: 09/507,297

(22) Filed: Feb. 18, 2000

(30) Foreign Application Priority Data

Feb. 19, 1999 (EA) ..... 199900417

(51) Int. Cl.[7] ..... H01Q 1/42
(52) U.S. Cl. ..... 343/872; 428/195; 428/919
(58) Field of Search ..... 343/872; 428/192, 428/193, 112, 195, 919; H01Q 1/42

(56) References Cited

U.S. PATENT DOCUMENTS 3,300,781 * 1/1967 Clough et al. ..... 343/18
4,495,239 * 1/1985 Pusch et al. ..... 428/192
5,281,460 * 1/1994 Cox ..... 428/112
5,312,678 * 5/1994 McCullough, Jr. et al. ..... 428/225

* cited by examiner

*Primary Examiner*—Don Wong
*Assistant Examiner*—Hoang Nguyen
(74) *Attorney, Agent, or Firm*—Blakely Sokoloff Taylor & Zafman

(57) ABSTRACT

A cover is proposed for camouflaging land-based military facilities, the cover comprising electrically conductive layers separated by dielectric interlayers and placed in a protective jacket. The outer layer of the protective jacket is radio-transparent. Wherein the electrically conductive layers are made in the form of ordered resonance structures in the form of grids of conductive threads. The size of the cells of such grids and the electrical resistance of threads from which they are made decrease from the outer layer to the inner. Wherein the effective part of the dielectric permeability of the conducting threads is proportional to the wavelength of the working frequency range.

2 Claims, 1 Drawing Sheet

COVER FOR CAMOUFLAGING MILITARY FACILITIES

FIELD OF THE INVENTION

The invention relates to camouflaging land-based military facilities and may be used to reduce the probability of detecting the latter by radar, radio-thermal and also thermal and optical means for intelligence and for aiming weapons.

PRIOR ART

Covers for camouflaging military facilities are known, which are multilayer constructions of electrically conductive layers disposed in a protective jacket. Such a cover is known, for example, from U.S. Pat. Ser. No. 3,300,781, class 343-18, Jan. 24, 1967. This cover comprises two or more identical multilayer packets of cloth with metallization of the first layer in each packet, which are placed in a jacket of protective color.

The surface resistance of the metallized layer is about 20 ohm/cm. In this construction the metallized layers serve simultaneously for thermal screening and for absorption of radio waves. Wherein, the requirements in respect to the electrical conduction of the layers are contradictory. For screening, the electrical resistance of the layers should be minimum (units of ohm/cm), while for the absorption of radio waves it should be several hundreds of ohm/cm.

Embodiments of the cover with different numbers of packets and values of electrical resistance are presented in the specification of the patent. Each of these embodiments has an advantage in either thermal insulation or in radio absorption. It should be noted that electrically conductive layers on a base of metallized films or cloths have a value of surface electrical resistance which does not make it possible to ensure high absorption of radio waves simultaneously in the centimeter and millimeter bands. Such a construction has expressed resonance properties in the narrow frequency band in which the radio wave absorption effect is manifested.

Furthermore, the range of frequencies in which a low level of reflection from radio-absorbing materials in the form of covers is observed is limited by the low radio-transparency (in the millimeter band of wavelengths) of jackets which have the necessary strength and other operating properties.

A physically caused relationship exists: the stronger and denser the jacket, the lower its radio-transparency.

SUMMARY OF THE INVENTION

The object of the present invention is to remove the aforementioned drawbacks and ensure a high level of absorption of waves over a wide range, including centimeter and millimeter waves.

This object is achieved by using ordered resonance structures of electrically conductive synthetic threads in the form of cloth grids as the absorbing layers. In order to exclude polarization dependence, the reflection factor of a grid cell has the configuration of a square. In order to expand the frequency band in which absorption in resonance grids is manifested, they are made of threads having a variance of the dielectric permeability in the centimeter and millimeter wave bands. The dielectric permeability of the fibers changes in proportion to a change in the wavelength.

In this case resonance between the electrically conductive layers is supplemented by resonance on elements of the electrically conductive grids, as a result of which there is an additional increase of absorption.

An increase in the radio transparency of the shell with the simultaneous provision of additional absorption therein in the millimeter band is achieved in that the shell is made inhomogeneous in the direction of thickness. The distance between neighboring inhomogeneities is comparable with the wavelengths of the millimeter band.

In respect to principle of operation, the proposed invention relates to radio-absorbing materials of the interference-absorption type.

In interference materials on the base of electrically conductive layers, separated by dielectric interlayers, the incident and the reflected electromagnetic waves mutually compensate each other. However, due to the absence of losses in the dielectric, such materials are narrow waveband.

Almost complete absorption of the incident energy and no reflection from the interface occur in gradient radio-absorbing materials. A sufficiently large thickness is necessary in order to ensure a smooth and gradual attenuation of the incident wave.

Absorption in the proposed device takes place in the electrically conductive layers which are made in the form of ordered resonance structures on the base of grids of conductive threads, and interference is ensured by the thickness of the separating dielectric interlayers. A combination of the principles of absorption and interference makes it possible to create a wide-band radio-absorbing material of relatively small thickness.

The electrically conductive layers used in the proposed device are distinctive in respect to their radio-engineering properties and principle of operation from the metallized films used in the prototype.

Depending on the electrical conduction of the threads used in the grids and on the dimensions of the grid cells, it is possible to obtain the required dispersive properties in the predetermined wavelength band.

BRIEF DESCRIPTION OF THE DRAWINGS

A cross section of the cover according to the invention is shown in the presented drawing. The cover comprises electrically conductive layers 1, 2, 3, made in the form of ordered resonance structures on the base of grids of conductive threads with cells, the size of which and the electrical resistance of the threads decrease from the outer layer to the inner, wherein the effective part of the dielectric permeability of the conductive threads is proportional to the wavelength of the working range. The electrically conductive layers 1, 2, 3 are divided by dielectric interlayers 4 and all of this construction is disposed in a protective jacket 5, the outer layer of which is transparent to radio waves.

The cover is placed on the outer surface 6 of a unit of the military facilities.

DETAILED DESCRIPTION OF THE INVENTION

Figure 1:
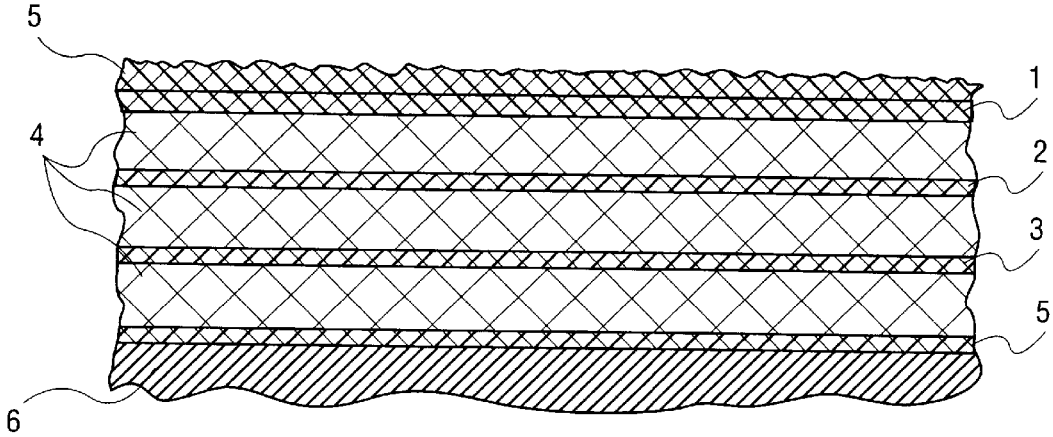

The principle of action of the cover according to the invention is as follows.

Incident electromagnetic waves are partially reflected in turn by the electrically conductive layers 1, 2, 3, and the surface of the unit 6. As a result of multiple reflection, taking the phase shift provided by the thickness of the dielectric interlayers 4 into account, the energy of the incident electromagnetic wave is converted in the electrically conductive layers 1, 2, 3, into thermal energy. The effect of absorption is intensified due to the manifestation of resonance in the structure of the electrically conductive layers. The protective jacket 5 of the cover is made inhomogeneous in thickness with the value of inhomogeneity comparable with one-fourth of the minimum wavelength of the working band, as a result of which dissipation and weakening of the field on the protective jacket is ensured in the shortwave part of the millimeter band because of the electromagnetic wave incident on the inhomogeneities.

The selected parameters of the construction make it possible to realize the process of absorption of electromagnetic radiation in a predetermined wavelength band, which is close to optimum.

Industrial Applicability

The cover for camouflaging land-based military facilities may be used to reduce the probability of detecting the facilities by radar and radio-thermal, as well as thermal and optical means for intelligence and for aiming weapons.

What is claimed is:

1. A cover for camouflaging land-based military facilities, the cover comprising electrically conductive layers separated by dielectric interlayers and placed in a protective jacket, an outer layer of which is radio-transparent, characterized in that the electrically conductive layers are made in the form of ordered resonance structures on the base of grids of conductive threads with cells, the size of which and the electrical resistance of the threads decrease from the outer layer to the inner, wherein the effective part of dielectric permeability of the conductive threads is proportional to the wavelength of the working frequency band.

2. A cover according to claim 1, characterized in that the protective jacket of the cover is made inhomogeneous in thickness, with the value of inhomogeneity comparable with one-fourth the minimum wavelength of the working band.

* * * * *

UNITED STATES PATENT AND TRADEMARK OFFICE

CERTIFICATE OF CORRECTION

PATENT NO. : 6,211,843 B1
DATED : April 3, 2001
INVENTOR(S) : Antipov et al.

It is certified that error appears in the above-identified patent and that said Letters Patent is hereby corrected as shown below:

Title page,
Item [75] Inventors, please delete "Moskovskaya oblast" and insert -- Dolgoprudny --.

Item [73] Assignee, please delete "Issledovatelsky" and insert -- Iss-Ledovatelsky --.

Signed and Sealed this

Second Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,211,843 B1
DATED : April 3, 2001
INVENTOR(S) : Antipov et al.

It is certified that error appears in the above-identified patent and that said Letters Patent is hereby corrected as shown below:

Title page,
Item [73], Assignee, please delete "Iss-Ledovatelsky" and insert -- Issledovatelsky --.

Signed and Sealed this

Seventh Day of January, 2003

JAMES E. ROGAN
*Director of the United States Patent and Trademark Office*